US006204458B1

(12) United States Patent
Chen et al.

(10) Patent No.: US 6,204,458 B1
(45) Date of Patent: Mar. 20, 2001

(54) SWITCH DEVICE

(75) Inventors: Chu-Mei Chen, Taipei; Jung-Kuo Huang, Tu-Chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/417,324

(22) Filed: Oct. 13, 1999

(30) Foreign Application Priority Data

Jul. 6, 1999 (TW) ..... 88211238

(51) Int. Cl.[7] ..... H01H 15/02
(52) U.S. Cl. ..... 200/284; 200/16 R; 200/16 D
(58) Field of Search ..... 200/16 R–16 D, 200/302.1, 284

(56) References Cited

U.S. PATENT DOCUMENTS 4,366,351 * 12/1982 Ditzig ..... 200/16 R
4,658,101 * 4/1987 Akimoto et al. ..... 200/16 R
4,833,280 * 5/1989 Bingo et al. ..... 200/16 D
4,841,109 * 6/1989 Sakakino et al. ..... 200/302.1

* cited by examiner

*Primary Examiner*—Michael Friedhofer
(74) *Attorney, Agent, or Firm*—Wei Te Chung

(57) ABSTRACT

A switch device comprises a base forming a plurality of spacing walls thereon. A plurality of receiving holes is formed on longitudinal edges of the base for receiving corresponding fixed contacts and movable contacts therein. A plurality of sliding members is mounted on the base and a cover is received over the base. A pair of locking blocks is formed at lateral sides of the base for engaging with a pair of locking slots formed at lateral sides of the cover. To aid mass production, each fixed contact comprises a contacting portion, a pair of shoulders formed on lateral edges of the contacting portion for connecting with a carrier plate and an insertion leg extending from the contacting portion. Each movable contact comprises a contacting arm, a pair of connecting shoulders connected with a carrier plate and an insertion portion extending to the opposite to the contacting arm. Each fixed contact and movable contact forms a V-cut for facilitating the process of removing the carrier from the contact plate.

6 Claims, 5 Drawing Sheets

SWITCH DEVICE

BACKGROUND OF THE INVENTION

The present invention relates to a switch device, and particularly to a switch device which can be easily assembled.

DESCRIPTION OF PRIOR ART

Conventional switch devices are classified as IC type switch and non-IC type switch devices. IC type switch devices have a plurality of contacts which are received in a base using an insertion molding process, the number of the contacts being adjusted to fit the mold used. An IC type switch does not meet the need for varying numbers of contacts in a mass production environment.

A non-IC type switch comprises a base forming a plurality of receiving passageways for receiving a corresponding number of movable contacts and fixed contacts, and a cover mounted on the base. A plurality of sliding members is received in the cover. When pushed, the sliding members press down on the movable contacts, and a reactionary force from the contacts to the sliding members is transmitted to the cover. Thus, a separating force acts between the cover and the base and the engagement between the cover and the base is not reliable. To solve the engagement problem, an adhesive is commonly used to secure the cover to the base. However, the adhesive sometimes seeps through to the contacts and influences the conductive ability of the switch.

Thus, there is a need for an improved switch device which is easily assembled and provides reliable electrical signal transmission.

BRIEF SUMMARY OF THE INVENTION

A main object of the present invention is to provide a switch device which is easily assembled and mass produced.

Another object of the present invention is to provide a switch device which provides reliable electrical signal transmission.

To fulfill the above-mentioned objects, a switch device according to the present invention comprises a base forming a plurality of spacing walls thereon, spaced equidistant from and parallel to each other. A projecting block is formed between adjacent spacing walls. Each spacing wall comprises a top surface with a pair of arched projections formed on lateral ends thereof. A pair of locking blocks is formed at lateral sides of the base. A plurality of receiving holes is defined in longitudinal edges of the base. A fixing contact plate and a movable contact plate each form a plurality of fixed contacts and movable contacts, respectively. Each fixed contact comprises a contacting portion, a pair of shoulders formed on lateral edges of the contacting portion for connecting with a carrier plate and an insertion leg extending from the contacting portion. A V-cut is formed in each connecting portion of the fixed contact for facilitating the process of removing the fixed contact plate from the carrier plate. Each movable contact comprises a contacting arm, a pair of connecting shoulders connected with a carrier plate and an insertion portion extending opposite the contacting arm. A V-cut is formed in each connecting shoulder for facilitating the process of removing the movable contact plate from the carrier plate. Insertion legs of the fixed contacts and insertion portions of the movable contacts are received in their respective receiving holes in the base. A plurality of sliding members is mounted on the base for selectively opening and closing electrical contact between the fixed and moveable contacts. A cover forms a plurality of openings for receiving corresponding sliding members. A pair of locking slots is formed at lateral sides of the cover for engaging with corresponding locking blocks on the base.

Other objects, advantages and novel features of the invention will become more apparent from the following detailed description when taken in conjunction with the accompanying drawings.

DETAILED DESCRIPTION OF THE INVENTION

Figure 1:
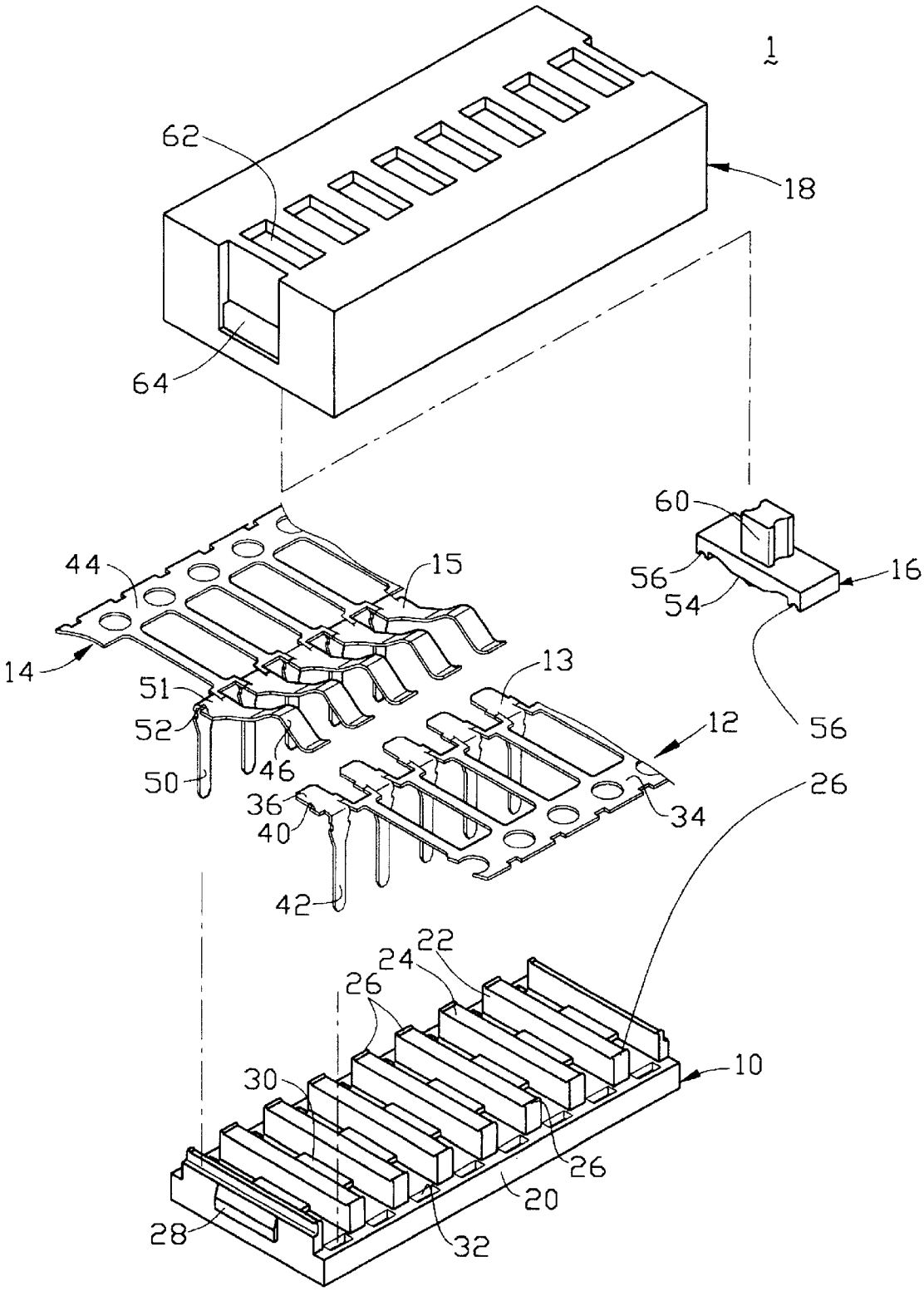
FIG. 1 is an exploded view of a switch device in accordance with the present invention.
Figure 2A:
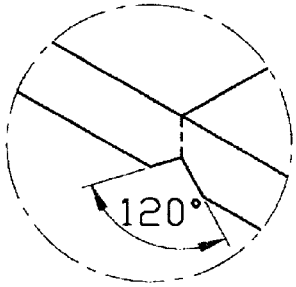
FIG. 2A is an enlarged view of a connecting portion of the fixing contact plate or the movable contact plate.
Figure 2:
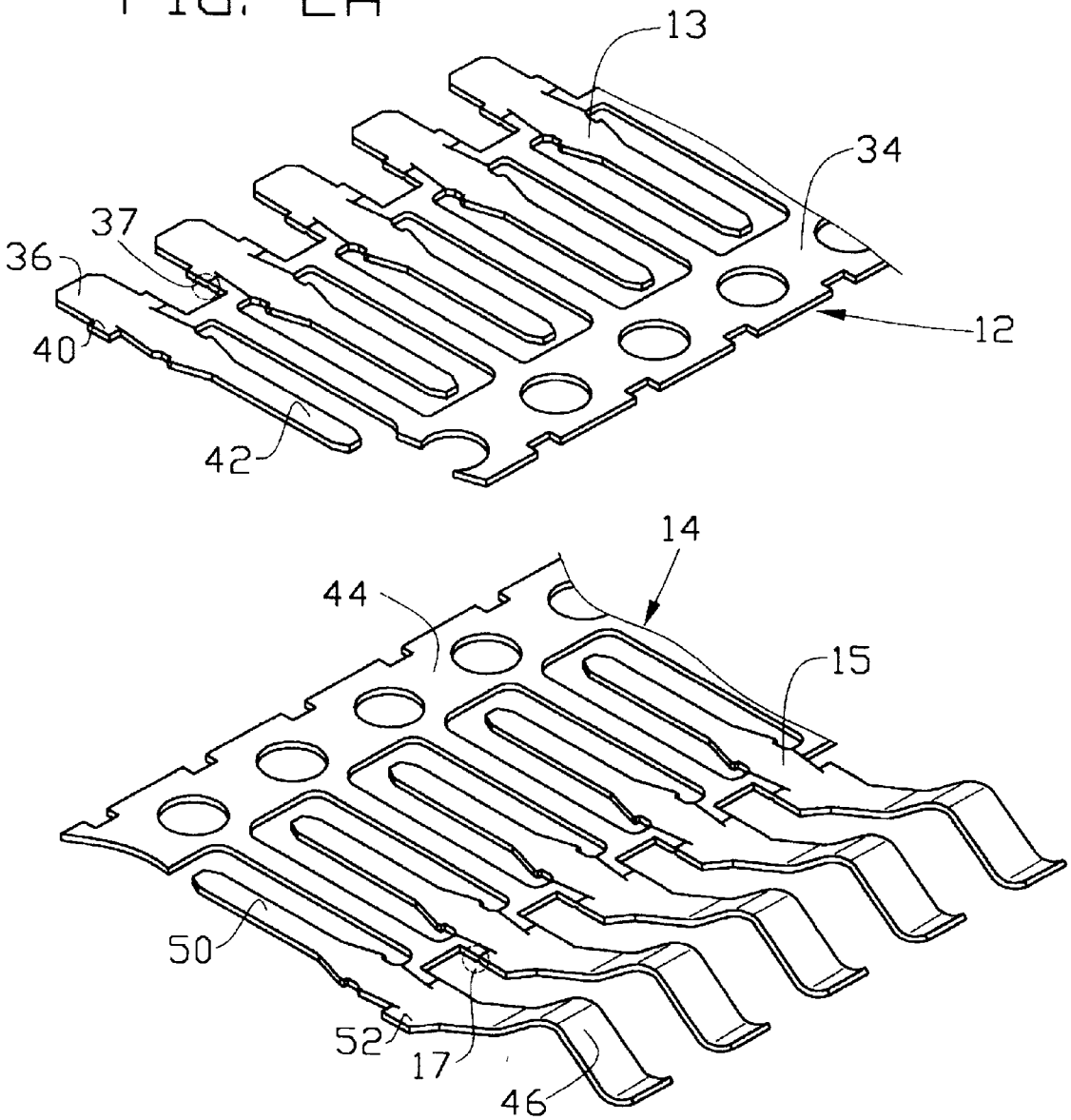
FIG. 2 is a perspective view of a fixing contact plate and a movable contact plate in accordance with the present invention.

Referring to FIGS. 1 and 2, a switch device 1 comprises a base 10 forming a plurality of spacing walls 22 thereon. A sliding member 16 is received in a cover 18. The base 10 comprises a body 20 defining a plurality of receiving holes 32 on longitudinal edges for receiving a fixing contact plate 12 and a movable contact plate 14. The spacing walls 22 are equidistantly formed on the body 20 and a projecting block 30 is formed in the space between every two adjacent spacing walls 22. Each spacing wall 22 forms a top surface 24 and a pair of arched projections 26 on lateral ends thereof. A pair of locking blocks 28 is formed at lateral sides of the base 10.

Figure 4:
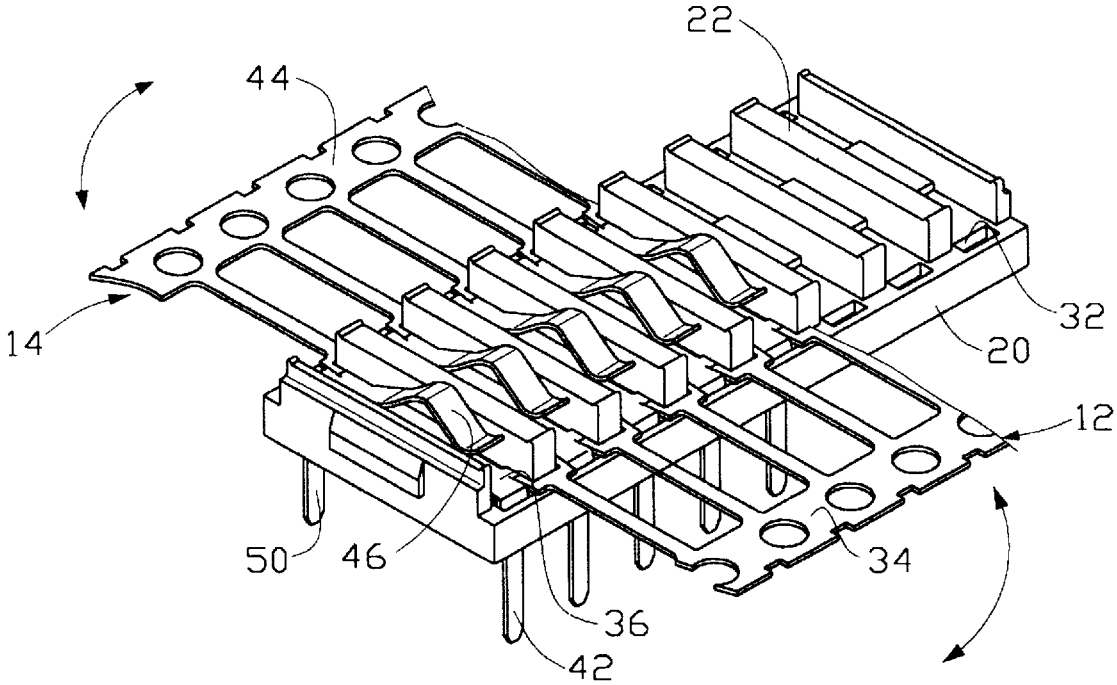
FIG. 4 is a perspective view of a fixing contact plate and a movable contact plate assembled in a base.

The fixing contact plate 12 and the movable contact plate 14 are formed by stamping a metal plate. Each fixed contact 13 comprises a contacting portion 36, a pair of shoulders 40 formed on lateral edges of the contacting portion 36 for connecting with a carrier plate 34 and an insertion leg 42 extending from the contacting portion 36. A V-cut is formed in each connecting portion 37 for facilitating the process of removing the carrier plate 34 from the fixing contact plate 12. The contacting portion 36 of the fixed contact 13 is plated to provide a reliable conductive surface, and the insertion leg 42 of the fixed contact 13 is received in the corresponding receiving hole 32 (FIG. 4) for securing the fixed contact 13 to the base 10.

The movable contact plate 14 comprises a plurality of movable contacts 15 connected to a carrier plate 44. Each movable contact 15 comprises a base portion 51, a contacting arm 46 extending from the base portion 51, a pair of connecting shoulders 52 formed at lateral edges for connecting with the carrier plate 44 and an insertion portion 50 extending opposite the contacting arm 46. A V-cut is formed in a connecting portion 17 of each movable contact 15 for easily removing the carrier from the movable contact plate 14. The contacting arms 46 have a bent portion near a mid-point thereof to increase their resilience for opening/closing contact with contacting portions 36.

Figure 3:
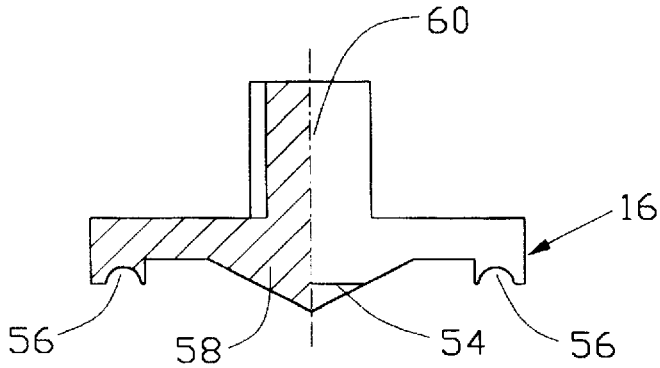
FIG. 3 is a cross-sectional view of a sliding member.

Referring to FIGS. 1 and 3, each sliding member 16 forms a pair of sliding portions 54 for slidingly engaging with an adjacent pair of top surfaces 24 of the spacing walls 22. A pair of arched slots 56 is formed at lateral ends of each sliding member 16 for engaging with corresponding arched projections 26 of the spacing wall 22. A V-shaped projection 58 extends from the bottom surface of each sliding member 16 toward corresponding projection blocks 30 of the body 20 for engaging with the contacting arm 46 of the corresponding movable contact 15. A pushing bar 60 is formed on a top surface of each sliding member 16 opposite the V-shaped projection 58.

The cover 18 is made of a plastic material and defines a plurality of openings 62 for receiving corresponding pushing bars 60. A pair of locking slots 64 is formed at lateral sides of the cover 18 for engaging with corresponding locking blocks 28 of the base 10.

Figure 5:
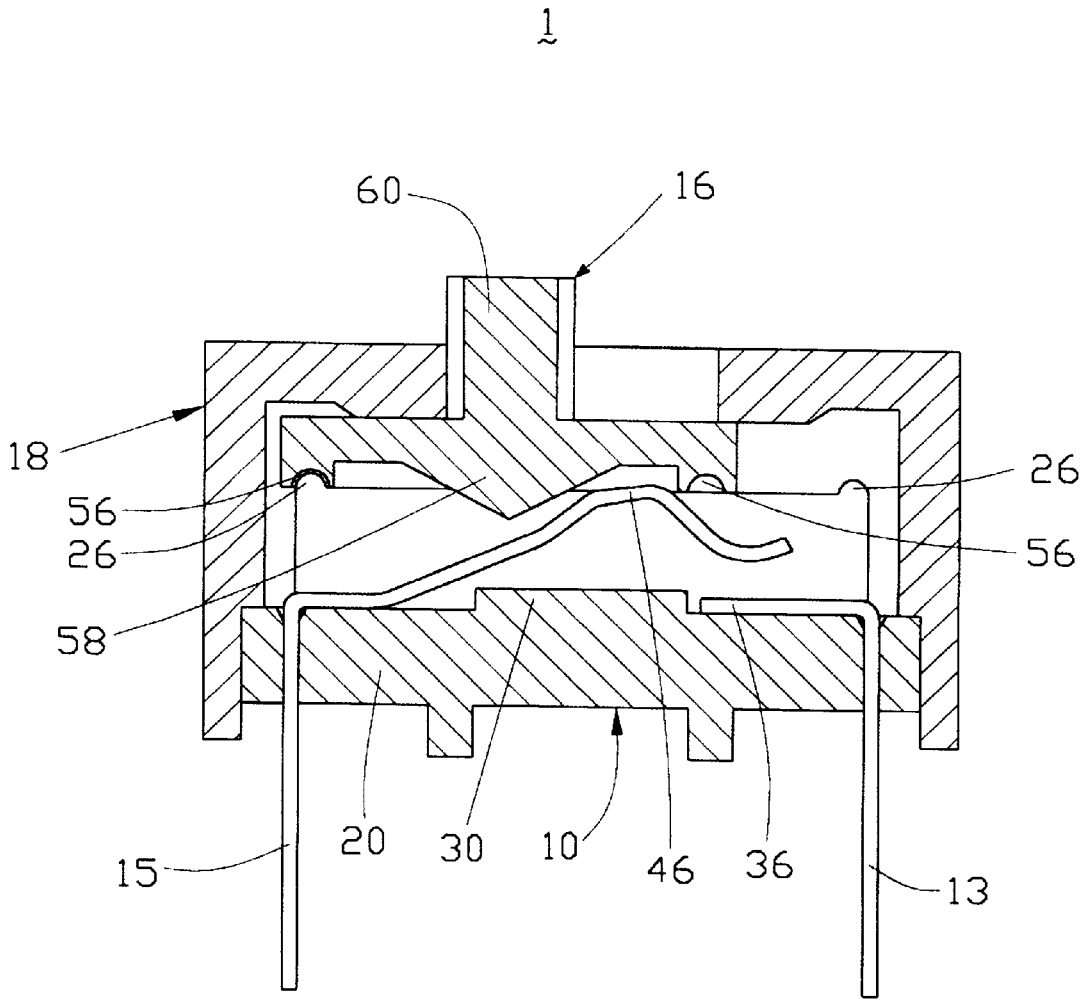
FIG. 5 is a cross-sectional view of a switch device assembled in an open state in accordance with the present invention.
Figure 6:
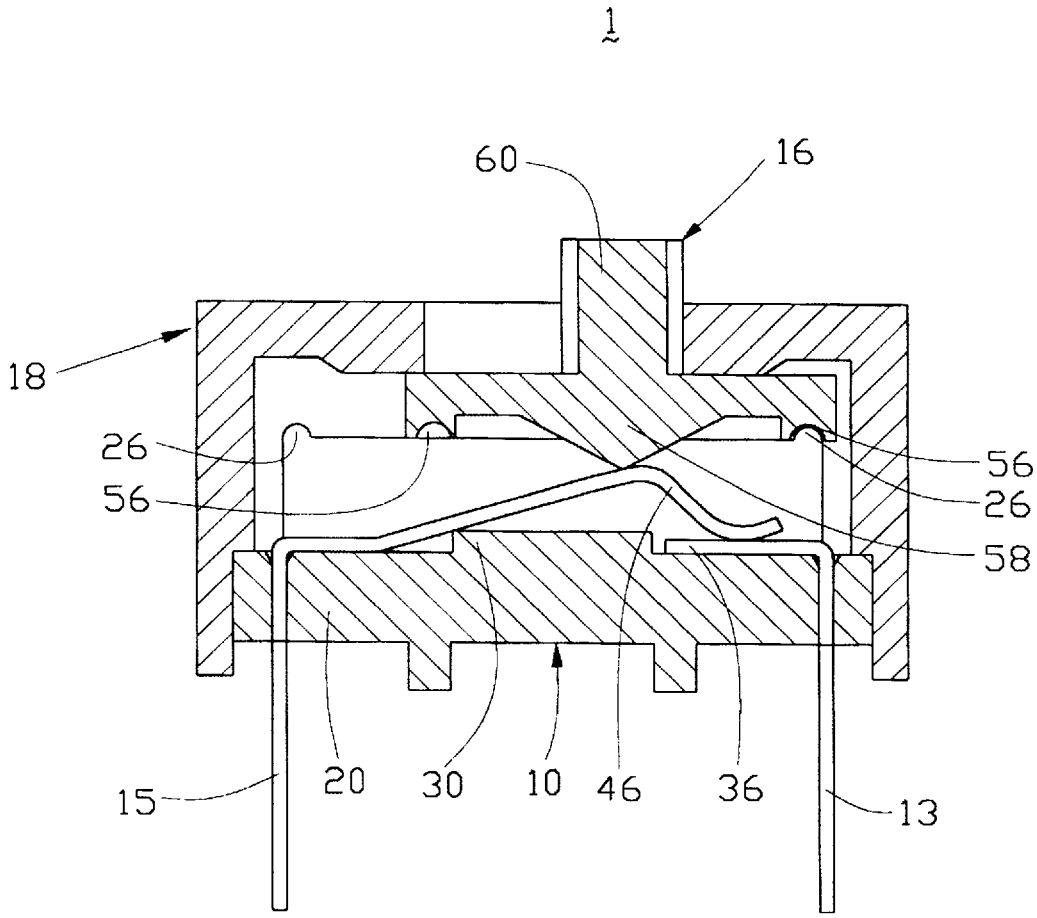
FIG. 6 is a cross-sectional view of a switch device assembled in a closed state in accordance with the present invention.

Referring to FIGS. 5 and 6, during assembly the insertion legs 42 of the fixing contact plate 12 and the insertion portions 50 of the movable contact plate 14 are respectively bent perpendicular to their corresponding contacting portions and contacting arms and are received in the corresponding receiving holes 32. Then, the carrier plates 34, 44 are removed from the contact plates 12, 14. The sliding members 16 are mounted on each pair of spacing walls 22 and are covered by the cover 18 whereby the pushing bars 60 extend out through the corresponding openings 62 therein. When a switch of the switch device 1 is in the open state (FIG. 5), the corresponding sliding member 16 is positioned at an end of the opening 62 and the arched slot 56 engages with a corresponding pair of arched projections 26. At this time the V-shaped projection 58 does not touch the contacting arm 46 of the corresponding movable contact 15. Accordingly, when the sliding member 16 is pushed to the other end of the opening 62, the contacting arm 46 of the corresponding movable contact 15 is pressed downward by the V-shaped projection 58 and electrically contacts the corresponding contacting portion 36 of the fixed contact 13, whereby the switch of the switch device 1 is put in a closed state.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A switch device comprising:

a base;

a cover mounted on the base;

a fixing contact plate forming a plurality of fixed contacts, each of the fixed contacts comprising a contacting portion, a pair of shoulders formed on lateral edges of the contacting portion for connecting with a carrier plate associated with the fixing contact plate, and an insertion leg extending from the contacting portion for vertically inserting into a base, a V-cut being formed at a junction between each of the shoulders and the carrier plate for facilitating removal of the carrier plate from the fixing contact plate;

a movable contact plate forming a plurality of movable contacts, each of the movable contacts comprising a base portion, a contacting arm extending from the base portion to form a bent portion, a pair of connecting shoulders formed at lateral edges for connecting with a carrier plate associated with the movable contact plate, and an insertion portion extending from another edge of the base portion opposite the contacting arm for vertically inserting into the base, a V-cut being formed at a junction between each of the connecting shoulders and the carrier plate for facilitating removal of the carrier plate from the movable contact plate;

a plurality of sliding members for urging the contacting arms of the movable contacts to engage with the contacting portions of the fixed contacts; and a locking device formed on a bottom face of each of the sliding members, said locking device being engagable with a complementary configuration formed on a top face of the base of the switch device to limit the sliding member to move between a closed and open positions of the switch.

2. The switch device as claimed in claim 1, wherein the bent portion is formed near a mid-point portion of the contacting arm to increase the resilience of the contacting arm.

3. A switch device comprising:

a base comprising a body defining a pair of straight longitudinal side edges and two rows of receiving holes beside the longitudinal side edges, and a plurality of spacing walls formed on the body;

a plurality of fixed contacts being received in one row of the receiving holes, each of the fixed contacts comprising a contacting portion, a pair of shoulders formed on lateral edges of the contacting portion, and an insertion leg extending from the contacting portion;

a plurality of movable contacts being received in the other row of the receiving holes, each of the movable contacts comprising a base portion, a contacting arm extending from the base portion, a pair of connecting shoulders formed on lateral edges of the base portion and an insertion portion extending from the base portion opposite to the contacting arm;

a plurality of sliding members each being slidably mounted on two adjacent spacing walls, each of the sliding members comprising a projection on a bottom surface thereof for urging the contacting arm of the movable contact to engage with the contacting portion of the fixed contact; and a cover assembled on the base and having a plurality of openings for accessing the sliding members; wherein each sliding member forms a pair of arched slots at lateral ends of the bottom surface thereof beside the projection, each spacing wall forming a pair of arched projections at lateral ends of a top surface thereof the arched projections being engagable within the arched slots, thereby limiting a movement of the sliding members.

4. The switch device as claimed in claim 3, wherein each of the sliding members forms a pair of sliding portions for slidably moving on one pair of adjacent spacing walls.

5. The switch device as claimed in claim 3, wherein the base forms a pair of locking blocks at lateral sides thereof.

6. The switch device as claimed in claim 3, wherein the cover forms a pair of locking slots at lateral sides thereof for engaging with corresponding locking blocks of the base.

* * * * *